US012446750B2

(12) United States Patent
Thorne et al.

(10) Patent No.: US 12,446,750 B2
(45) Date of Patent: Oct. 21, 2025

(54) FLEXIBLE FLAP FOR USE ON A CLEANING TOOL

(71) Applicant: Origyn LLC, Wayland, MA (US)

(72) Inventors: Jason Thorne, Dover, MA (US); Sam Liu, Suzhou (CN)

(73) Assignee: Origyn LLC, Wayland, MA (US)

( * ) Notice: Subject to any disclaimer, the term of this patent is extended or adjusted under 35 U.S.C. 154(b) by 0 days.

(21) Appl. No.: 18/451,338

(22) Filed: Aug. 17, 2023

(65) Prior Publication Data

US 2024/0057839 A1 Feb. 22, 2024

Related U.S. Application Data

(60) Provisional application No. 63/399,019, filed on Aug. 18, 2022.

(51) Int. Cl.

| | |
|---|---|
| ***A47L 13/12*** | (2006.01) |
| ***A46B 9/02*** | (2006.01) |
| ***A47L 13/022*** | (2006.01) |
| ***A47L 13/08*** | (2006.01) |

(52) U.S. Cl.

CPC ..... *A47L 13/12* (2013.01); *A46B 9/026* (2013.01); *A47L 13/022* (2013.01); *A47L 13/08* (2013.01); *A46B 2200/3033* (2013.01)

(58) Field of Classification Search

CPC ..... A47L 13/10; A47L 13/12; A47L 13/08

See application file for complete search history.

(56) References Cited

U.S. PATENT DOCUMENTS

2020/0305672 A1* 10/2020 Johnson ..... A47L 11/24
2023/0058126 A1* 2/2023 Zhou ..... A47L 9/0477

FOREIGN PATENT DOCUMENTS

CN 112218983 A * 1/2021 ..... B08B 1/005
CN 217310124 U * 8/2022

* cited by examiner

*Primary Examiner* — Shay Karls
(74) *Attorney, Agent, or Firm* — Finch & Maloney PLLC

(57) ABSTRACT

A flexible flap coupled to the bottom of a cleaning tool is designed to have a distal end that contacts the floor and scrapes along the floor as the cleaning tool is moved across the floor in order to help guide debris into a catch tray. The flexible flap also has a design such that the distal end can curl inwards after interaction with an obstacle (e.g., recess or protrusion of the floor surface) and continue to move across the floor picking up debris, even after the distal end of the flexible flap has been curled.

22 Claims, 7 Drawing Sheets

FLEXIBLE FLAP FOR USE ON A CLEANING TOOL

CROSS REFERENCE TO RELATED APPLICATIONS

This application claims the benefit of U.S. Provisional Application No. 63/399,019, filed Aug. 18, 2022, the disclosure of which is incorporated by reference herein in its entirety.

BACKGROUND

Cleaning tools such as sweeper devices have been used for decades to aid in cleaning dirt and other debris from floors or other surfaces. Sweepers often contain a built-in area to collect dirt, but efficiently moving the dirt from the surface up into the dirt catch tray can be difficult. Accordingly, there exist some drawbacks and other unsolved issues that limit the convenience of sweeping tools.

BRIEF DESCRIPTION OF THE DRAWINGS

Features and advantages of embodiments of the claimed subject matter will become apparent as the following Detailed Description proceeds, and upon reference to the Drawings, in which:

Figure 1:
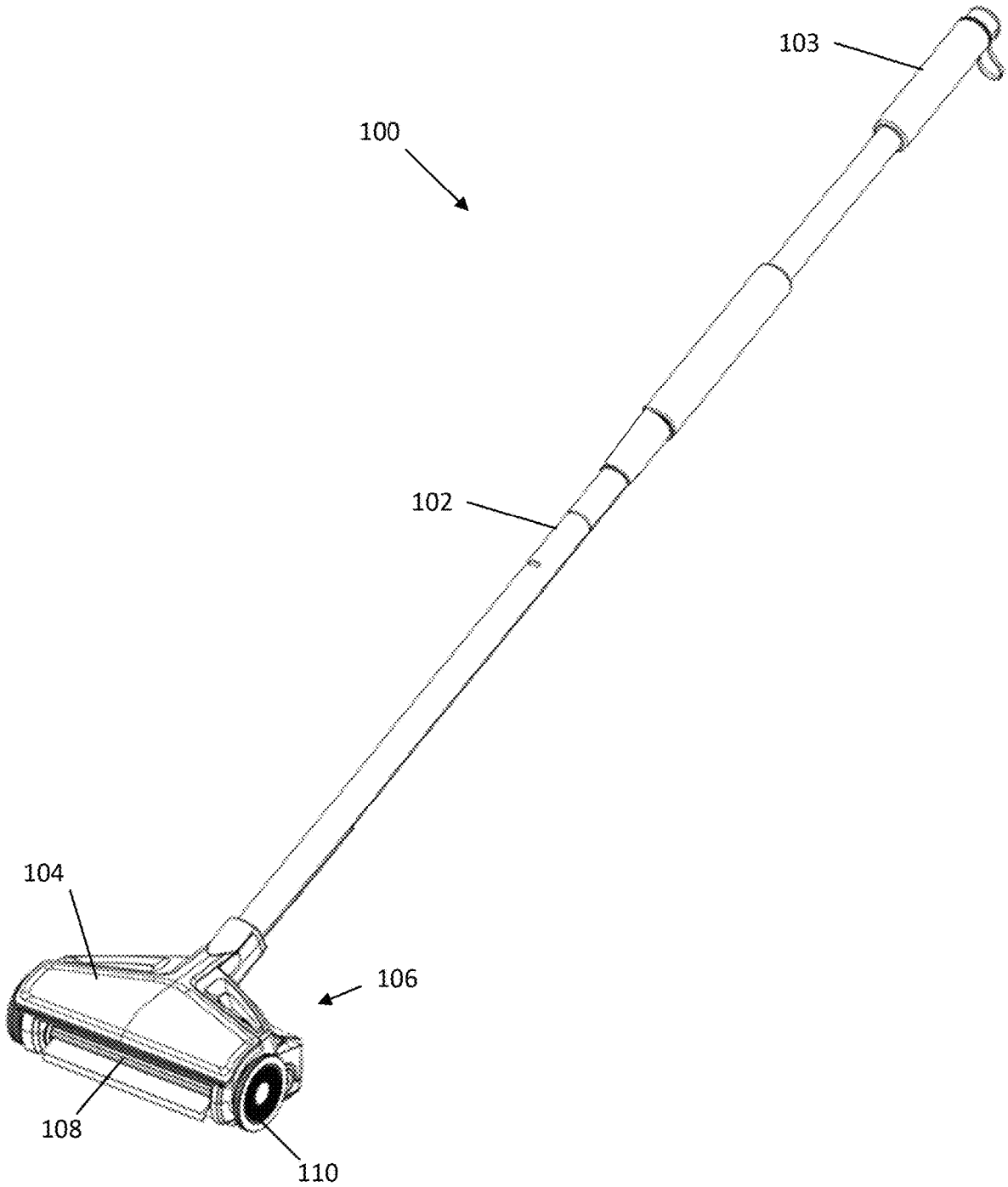
FIG. 1 illustrates a perspective, three-dimensional view of a sweeping tool, in accordance with some embodiments of the present disclosure.

Although the following Detailed Description will proceed with reference being made to illustrative embodiments, many alternatives, modifications, and variations thereof will be apparent in light of this disclosure.

DETAILED DESCRIPTION

As noted above, there are some non-trivial issues with cleaning equipment such as sweepers. Many of the issues pertain to matters of convenience for the user. For example, sweeper systems may provide their own catch tray for storing debris, but actually moving the debris into the catch tray can be challenging. A rotating brush head is often used to move the debris towards the catch tray, but some debris can be missed or it can build up near the entrance of the catch tray and be pushed across the surface beneath the sweeper.

Accordingly, a cleaning tool is provided herein that solves many of these problems through the use of a compliant scraper to help guide debris into a catch tray. The compliant scraper can comprise a flexible flap that may be designed to integrate seamlessly with a fixed ramp structure to provide a continuous surface from the floor up towards the catch tray. In this way, the debris can travel along a surface of the flexible flap and onto a ramp before being pushed into the catch tray. According to some embodiments, the flexible flap is designed to have a distal end that contacts the floor and scrapes along the floor as the cleaning tool is moved across the floor. The flexible flap also has a design such that the distal end can curl inwards after interaction with an obstacle (e.g., a negative obstacle such as a recess or a positive obstacle such as a protrusion of the floor surface) and continue to move across the floor picking up debris, even after the distal end of the flexible flap has been curled. As used herein, curl or curling inwards means that the distal end of the flap curls downwards and away from the leading end of the cleaning tool. The flexible flap design described herein may be used on any type of surface cleaning tool, such as a wet or dry sweeper product, a vacuum cleaner, or a robot cleaner, to name a few examples.

In an example embodiment, a floor cleaning tool includes an elongated handle having a proximal end and a distal end, a bracket structure coupled to the distal end of the elongated handle, and a brush assembly coupled to the bracket structure. The brush assembly includes a rotatable brush head, a catch tray configured to collect debris swept up by the rotatable brush head, a ramp structure adjacent to the catch tray and having a top surface, and a compliant scraper comprising a flexible flap and an anchor portion. The anchor portion is coupled to the ramp structure such that the flexible flap extends away from the ramp structure. A top surface of the flexible flap is substantially coplanar with the top surface of the ramp structure.

In an example embodiment, a brush assembly is designed for use with a cleaning tool and includes a rotatable brush head, a catch tray configured to collect debris swept up by the rotatable brush head, a ramp structure adjacent to the catch tray and having a top surface, and a compliant scraper comprising a flexible flap and an anchor portion. The anchor portion is coupled to the ramp structure such that the flexible flap extends away from the ramp structure. A top surface of the flexible flap is substantially coplanar with the top surface of the ramp structure.

According to an embodiment, a method of using a brush assembly on a cleaning tool includes exerting a force upon the brush assembly to move the brush assembly across a substrate surface to be cleaned; rotating a brush head within the brush assembly, the brush head having a plurality of bristles, wherein rotation of the brush head guides debris towards a flexible flap, wherein a first surface of a distal portion of the flexible flap maintains contact with the substrate surface as the brush assembly moves across the substrate surface; and in response to the flexible flap moving across an obstacle, curling at least the distal portion of the flexible flap such that a second surface of the distal portion of the flexible flap contacts the substrate surface, the second surface being opposed to the first surface.

The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous. When used to describe a range of dimensions, the phrase "between X and Y" represents a range that includes X and Y.

Spatially relative terms, such as "beneath," "below," "lower," "above," "upper," and the like, may be used herein for ease of description to describe one element or feature's relationship to another element (s) or feature (s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 illustrates a perspective three-dimensional view of a cleaning tool 100, according to an embodiment. Cleaning tool 100 includes an elongated handle 102 to allow for user to comfortably grasp elongated handle 102 at one or two positions to perform pushing motions with cleaning tool 100. Elongated handle 102 may be formed of any sufficiently stiff material, such as metal, wood, or hard plastic. In some embodiments, elongated handle 102 is made from aluminum.

A proximal end of elongated handle 102 includes a grip 103, according to an embodiment. Grip 103 may be ergonomically designed for an adult hand and may be made from a softer material compared to elongated handle 102. In some embodiments, a second grip (not illustrated) is located along the length of elongated handle 102 such that both hands can be comfortably placed with one hand on grip 103 and the second hand on the second grip. In some embodiments, elongated handle 102 includes telescoping portions to adapt its length. In some embodiments, elongated handle 102 has a length between about 50" and about 60".

According to some embodiments, a bracket 104 is coupled to a distal end of elongated handle 102. In some embodiments, bracket 104 is formed from a metal, such as stainless steel. A top, flattened portion of bracket 104 may be coupled directly to the distal end of elongated handle 102 and to a brush assembly 106, which contains the tools used to clean the floor surface and contain the debris removed from the floor surface. For example, brush assembly 106 may include a rotatable brush head 108 and a catch tray (not shown) for capturing debris. One or more wheels 110 may be coupled to either bracket 104 or to brush assembly 106 to allow for brush assembly 106 to glide more easily across a floor surface.

In some embodiments, bracket 104 is free to rotate forwards and backwards while brush assembly 106 remains flat on the floor surface. The free rotation of bracket 104 allows for elongated handle 102 to rotate along with bracket 104 and can be used to rotate elongated handle towards the floor to push brush assembly 106 under furniture or other obstacles that would otherwise hinder progress. In one example, bracket 104 may rotate such that elongated handle 102 is substantially parallel with the floor surface. In another example, bracket 104 may rotate into a position that is substantially perpendicular to the floor surface, thus allowing cleaning tool 100 to stand on its own.

Figure 2A:
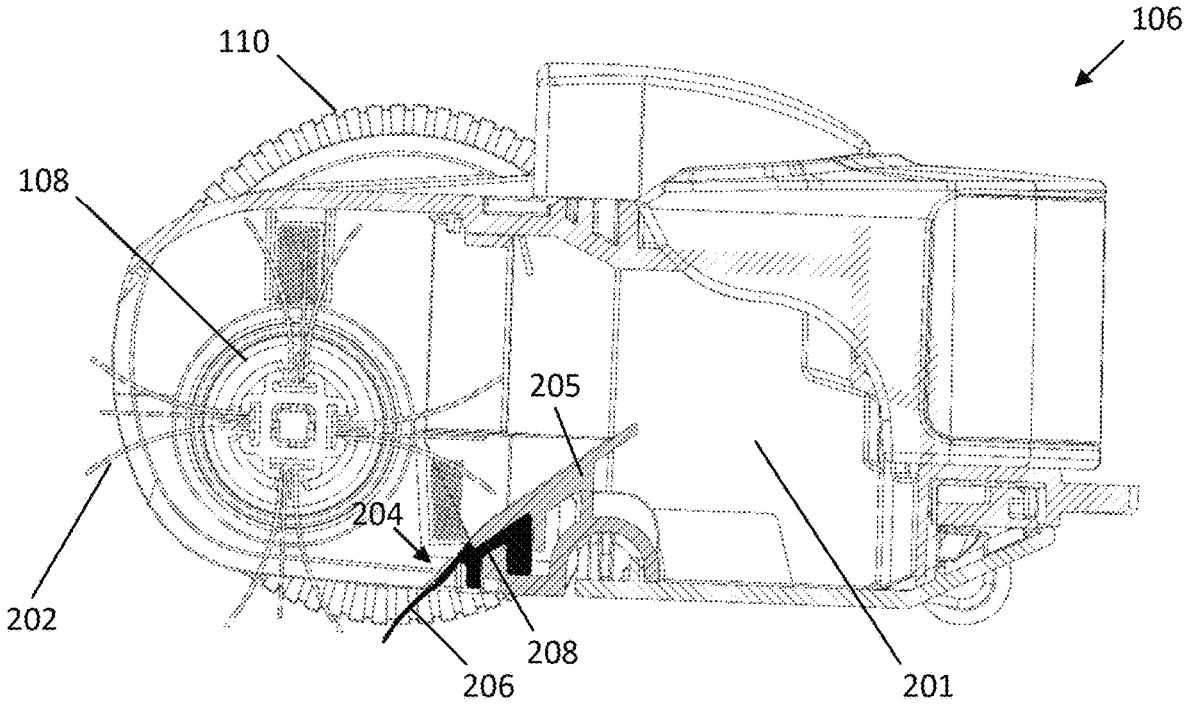
FIGS. 2A and 2B illustrate a cross-section view through a portion of a brush assembly on a sweeping tool having a compliant scraper including a flexible flap adjacent to a brush head, in accordance with some embodiments of the present disclosure.
Figure 2B:
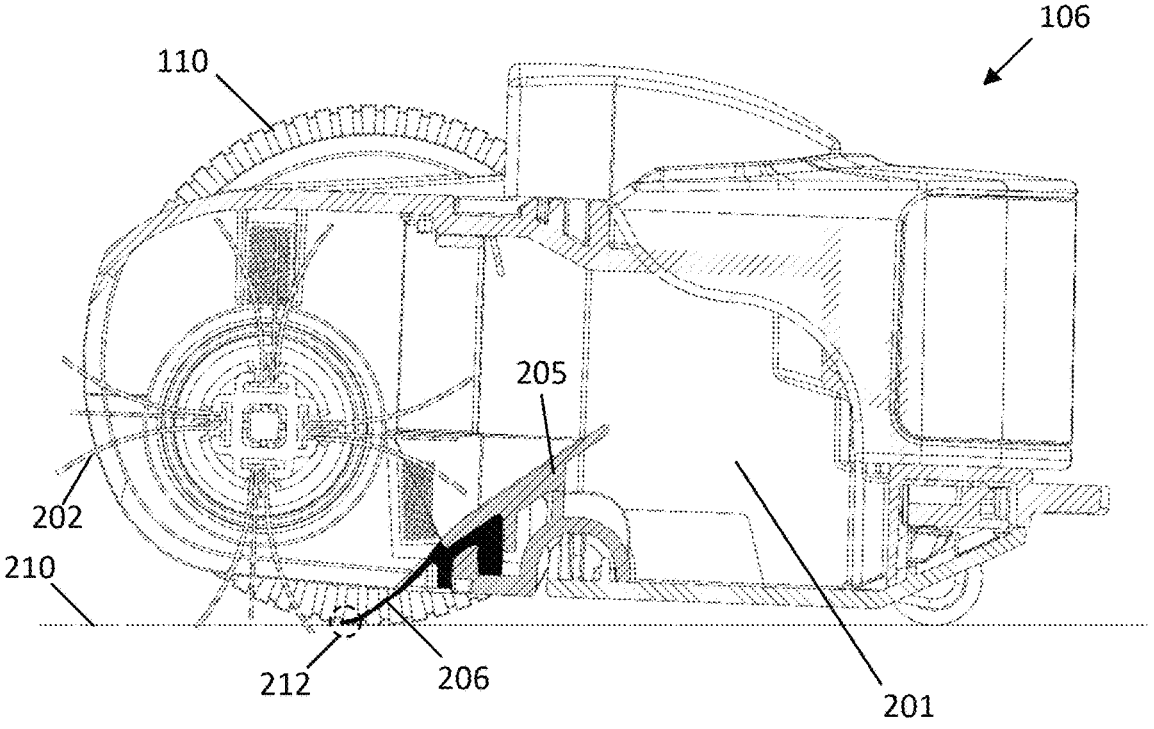

FIGS. 2A and 2B illustrate a cross-section view of an interior portion of brush assembly 106, according to an embodiment. As noted above, brush assembly 106 includes a rotatable brush head 108 and a catch tray 201. Rotatable brush head 108 may include any number of brushes or bristles 202 radially extending out from a tubular structure that rotates to move the brushes or bristles 202 in a continuous circular direction. The rotating brushes or bristles 202 of rotatable brush head 108 sweep up any debris in their path and push the debris towards a compliant scraper 204 where the debris is ultimately deposited within catch tray 201 on the other side of an inclined ramp structure 205. In some embodiments, movement of brush assembly 106 across a floor surface causes rotation of rotatable brush head 108. In some embodiments, rotatable brush head 108 is coupled to one or more wheels 110 that move along the floor surface, such that rotation of one or more wheels 110 cause a corresponding rotation of rotatable brush head 108. In some other embodiments, a motor is included within brush assembly and actuates the rotation of rotatable brush head 108.

According to some embodiments, compliant scraper 204 includes a flexible flap 206 and an anchor portion 208. Each of flexible flap 206 and anchor portion 208 may be formed from a flexible material, for instance a polymer material such as polyvinyl chloride (PVC). In some embodiments, only flexible flap 206 is formed from PVC while anchor portion 208 is formed from a different material. Other polymer materials for at least flexible flap 206 may include silicone, transparent exopolymer particles (TEP), thermoplastic polyurethane (TPU), or thermoplastic rubber (TPR). Anchor portion 208 may be fixed to ramp structure 205 such that flexible flap 206 extends down and away from the inclined surface of ramp structure 205. Flexible flap 206 can be made, for example, by extrusion or molding. It can be of or include an anti-static material to reduce accumulation of debris and can have memory that allows it to return to its original shape after 100, 1,000 or 10,000 deformations.

FIG. 2B illustrates brush assembly 106 placed on a substrate surface 210. Accordingly, one or more wheels 110 may make direct contact with substrate surface 210. Substrate surface 210 may represent any surface to be cleaned, such as a floor surface, tabletop surface, countertop surface, couch cushion surface, etc.

According to some embodiments, a distal end 212 of flexible flap 206 also contacts substrate surface 210. Distal end 212 may move along substrate surface 210 to help scrape up any debris in front of flexible flap 206. In some examples, bristles 202 contact at least a portion of flexible flap 206 as they rotate. In other examples, bristles 202 are positioned far enough away from flexible flap 206 that they do not contact any portion of flexible flap 206 as they rotate. Flexible flap 206 has an elasticity that allows it to bend at distal end 212 as it contacts substrate surface 210 while maintaining an inclined surface that leads up to ramp structure 205. According to some embodiments, distal end 212 that contacts substrate surface 210 makes up between 10% and 25% of the total length of flexible flap 206. Further details regarding both flexible flap 206 and anchor portion 208 are provided herein.

Figure 3:
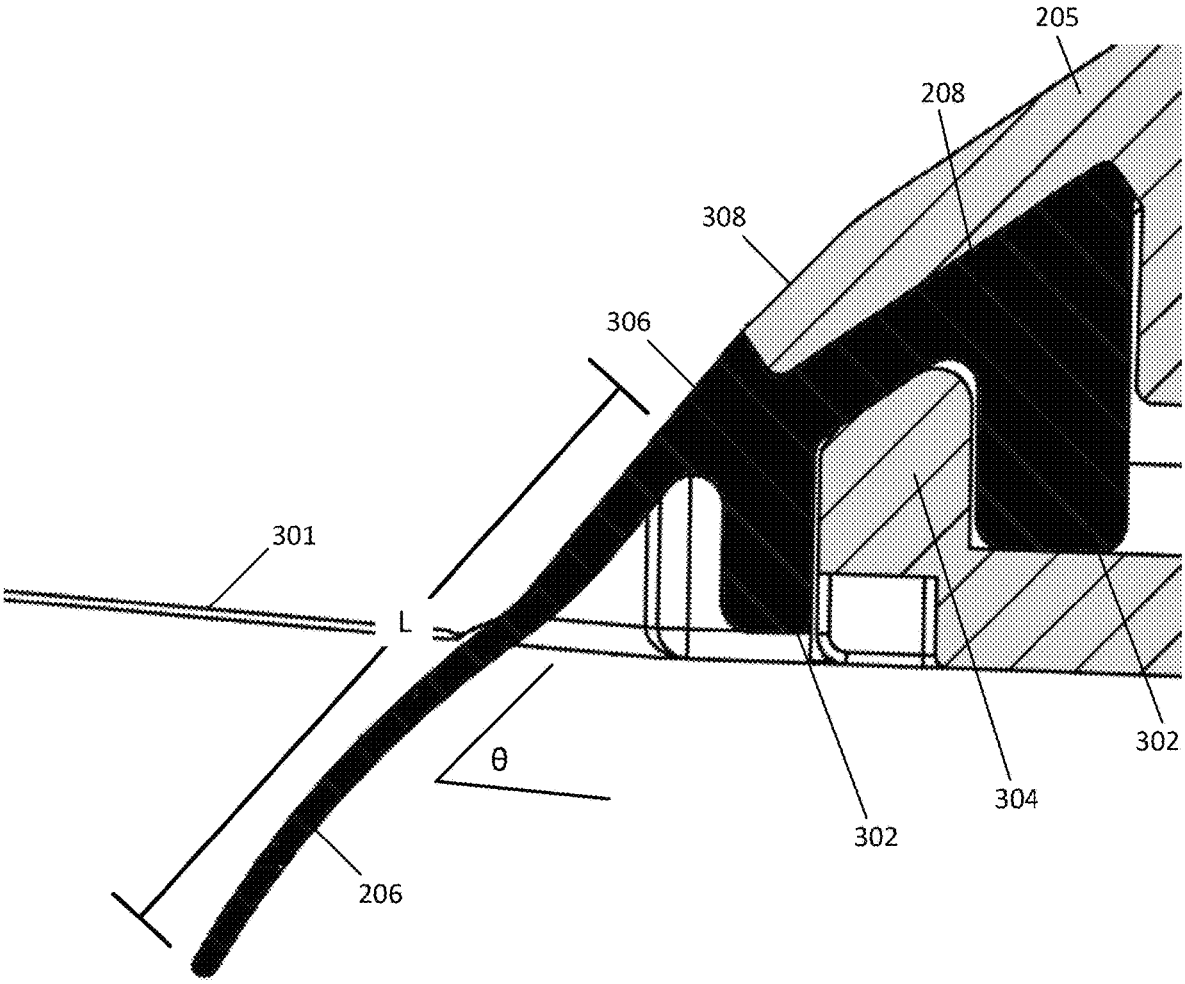
FIG. 3 illustrates a closer view of the flexible flap, in accordance with some embodiments of the present disclosure.

FIG. 3 illustrates a closer view of flexible flap 206, anchor portion 208, and ramp structure 205 according to some embodiments. Flexible flap 206 may have a total length L extending away from anchor portion 208 between about 8 mm and about 14 mm. In one example, flexible flap 206 has a total length around 11 mm. Flexible flap 206 may be designed to extend from anchor portion 208 at an angle θ with respect to a baseplate 301 along a bottom portion of brush assembly 106. In some embodiments, angle θ is between about 30 degrees and about 60 degrees, or between about 45 degrees and about 50 degrees. In some embodiments, flexible flap 206 is designed to have a very acute angle with respect to baseplate 301, such as between 10 degree and 30 degrees. In some embodiments, flexible flap 206 is designed to be substantially parallel to baseplate 301 (e.g., an angle of 0 degrees±2 degrees).

According to some embodiments, anchor portion 208 is fixed within ramp structure 205 via one or more legs 302 that extend around one or more corresponding pillars 304 of ramp structure 205. Legs 302 of anchor portion 208 and pillars 304 of ramp structure 205 may interlock together in an alternating fashion to secure anchor portion 208 to ramp structure 205. In some embodiments, pillars 304 can be removed and reinstalled to facilitate removal or installation of flexible flap 206. In other cases, flexible flap 206 can be slid into place without removal or loosening of pillars 304. Other anchoring schemes are possible as well, such as through the use of various adhesives and/or other interlocking shapes.

According to some embodiments, anchor portion 208 is fixed such that a top surface 306 of a proximal end of flexible flap 206 is substantially co-planar with a top surface 308 of ramp structure 205). In some examples, a seamless transition occurs between top surface 306 and top surface 308. In this way, debris that moves up the inclined flexible flap 206 transitions from flexible flap 206 to ramp structure 205 without getting caught or stuck before it is deposited within catch tray 201. Accordingly, top surface 308 of ramp structure 205 may also be at the angle θ, with respect to a baseplate 301, between about 30 degrees and about 60 degrees, or between about 45 degrees and about 50 degrees. In some embodiments, top surface 308 of the ramp structure 205 has a very acute angle with respect to baseplate 301, such as between 10 degree and 30 degrees. In some embodiments, top surface 308 is designed to be substantially parallel to baseplate 301 (e.g., an angle of 0 degrees±2 degrees). Top surface 306 may be in the same plane as top surface 308 or it can deviate by less than 45 degrees, less than 30 degrees, less than 10 degrees or less than 5 degrees.

Flexible flap 206 may have a thickness that is greater at a proximal end (e.g., adjacent to anchor portion 208) compared to its distal end. For example, flexible flap 206 may have a thickness at its proximal end between about 0.5 mm and about 0.9 mm and a thickness at its distal end between about 0.2 mm and about 0.6 mm. In one example, flexible flap 206 has a thickness of around 0.7 mm at its proximal end and a thickness of around 0.4 mm at its distal end.

Figure 4:
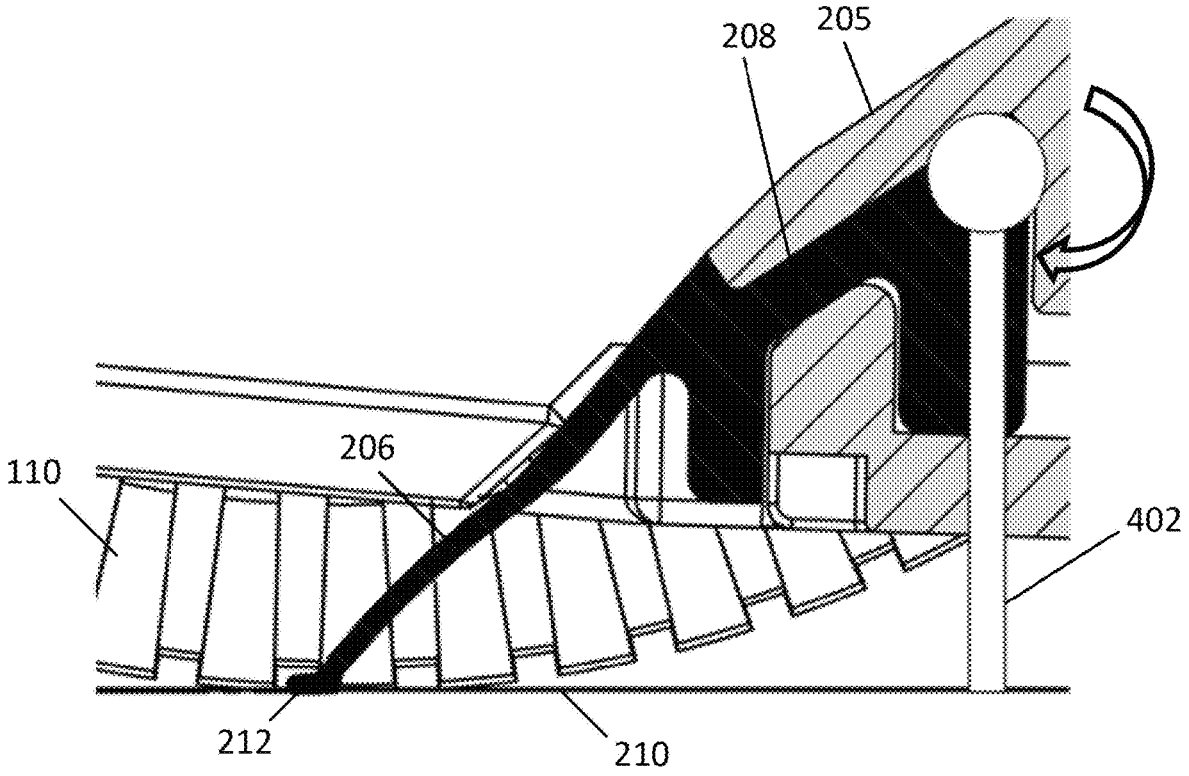
FIG. 4 illustrates a view of the flexible flap in an arrangement with a member extension, in accordance with some embodiments of the present disclosure.

FIG. 4 illustrates the operation of an optional member 402 that allows at least flexible flap 206 to tilt upwards relative to the rest of brush assembly 106 on a backwards stroke, according to some embodiments. FIG. 4A illustrates an example operation of brush assembly 106 as it moves across substrate surface 210. One or more wheels 110 directly contact substrate surface 210 and distal portion 212 of flexible flap 206 scrapes along substrate surface 210 to help pick up debris. In some examples, distal portion 212 that contacts substrate surface 210 may be between about 1.5 mm and about 2.0 mm.

According to some embodiments, member 402 extends downwards away from brush assembly 106 (e.g., towards substrate surface 210 when brush assembly 106 is placed on substrate surface 210). A proximal end of member 402 may be coupled to anchor portion 208 and/or ramp structure 205. A distal end of member 402 may extend down such that it leaves a small clearance between itself and substrate surface 210 (e.g., less than 5 mm, less than 3 mm or around a 2 mm gap). In some examples, distal end of member 402 is around 2 mm above a bottom plane of wheel 110.

Member 402 may be rigidly coupled to anchor portion 208, ramp structure 205, or to both. According to some embodiments, a backwards stroke of brush assembly 106 across substrate 210 causes member 402 to rotate in the direction of the curved arrow. This rotation causes a corresponding upwards rotation of at least flexible flap 206 to allow debris to more easily move backwards into catch tray 201. In some embodiments, the rotation of one or more wheels 110 on a backwards stroke of brush assembly 106 across substrate 210 acts upon a mechanism to lift flexible flap 206 and/or ramp structure 205 to allow debris to more easily move backwards into catch tray 201.

Figure 5:
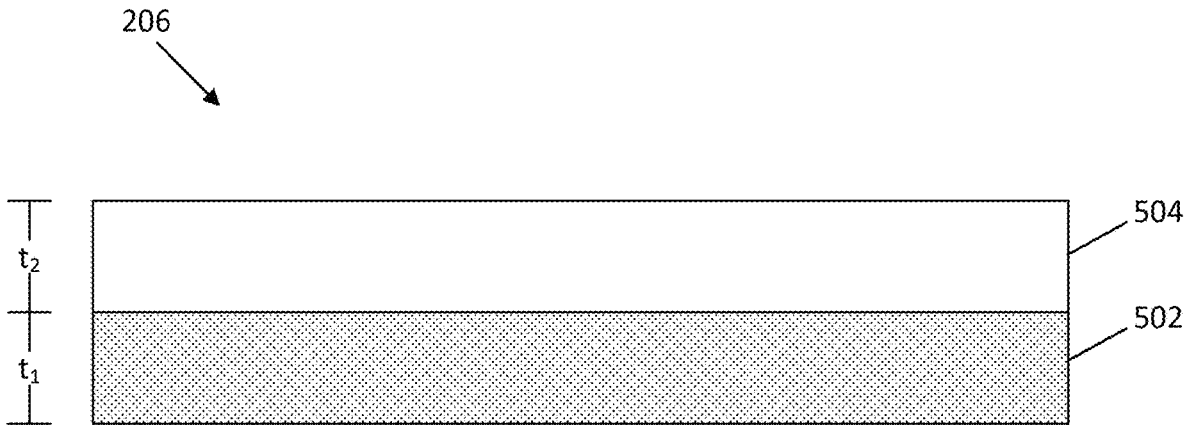
FIG. 5 illustrates a layer structure of a flexible flap, in accordance with some embodiments of the present disclosure.

As noted above, flexible flap 206 may be fully formed from a unitary material such as a single piece of polymer like PVC. However, in some embodiments, flexible flap 206 has more than one material layer. The multiple material layers may be different polymer materials or different material types, such as fabric layers and polymer layers. FIG. 5 illustrates an example two-layer structure for flexible flap 206. According to some embodiments, flexible flap 206 has a first layer 502 and a second layer 504. First layer 502 may be on the underside of flexible flap 206 such that first layer 502 contacts substrate surface 210 (e.g., when flexible flap 206 is not curled on itself). In some embodiments, first layer 502 includes a woven or nonwoven fabric material, such as any of polyester fiber, polyamide, spandex, acrylic fiber, polypropylene fiber, vinylon, recycled polyethylene terephthalate (PET) fabric, or nonwoven cloth. Generally, any synthetic or natural fiber material may be used for first layer 502. First layer 502 may have a thickness between about 0.2 mm and about 0.4 mm and in some cases the thickness can vary across the length and/or the width of the flexible flap.

According to some embodiments, second layer 504 includes a polymer material such as any of PVC, silicone, TEP, TPU, or TPR. Second layer 504 may have a thickness between about 0.05 mm and about 0.15 mm. In some embodiments, the thickness of second layer 504 along the length of flexible flap 206 becomes greater closer to anchor portion 208. This means that the flexible flap can increase in stiffness from the distal to the proximal end. In one example, first layer 502 includes polyester fiber while second layer 504 includes silicone. First layer 502 can overlap second layer 504 by greater than 25%, greater than 50% or greater than 75% of the surface of second layer 504. In other embodiments first layer 502 can overlap second layer 504 by less than 100%, less than 90%, less than 75% or less than 50% of the surface of second layer 504.

Figure 6A:
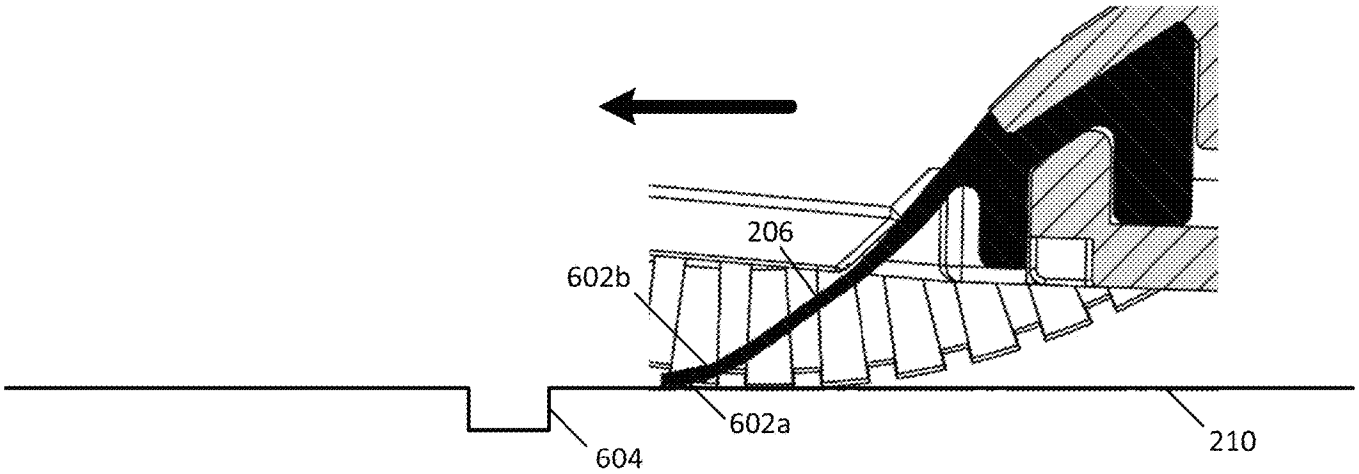
FIGS. 6A-6D illustrate different views of a flexible flap as its moves across an example surface, in accordance with some embodiments of the present disclosure.

FIGS. 6A-6D illustrate an example operation of brush assembly 106 including the bending of flexible flap 206 as it moves along substrate surface 210. FIG. 6A illustrates the movement of brush assembly 106 having flexible flap 206 across substrate surface 210 such that a first surface 602*a* at a distal portion of flexible flap 206 contacts substrate surface 210. An opposite second surface 602*b* provides the top surface of flexible flap 206 upon which debris can contact before moving upwards onto ramp structure 205 and ultimately into catch tray 201. As noted above, the distal portion of flexible flap 206 may scrape along substrate surface 210 as brush assembly 106 moves in the direction of the arrow. During the movement of brush assembly 106, brush head 108 rotates such that the bristles 202 coupled to brush head 108 guide any debris on the floor towards flexible flap 206. Debris can be pushed directly or may be imparted with enough momentum to move up flexible flap 206.

According to some embodiments, an obstacle 604 is present along substrate surface 210. Obstacle 604 may represent a recess or divot (as illustrated). In other examples, obstacle 604 may be a protrusion off of substrate surface 210 or it may represent a sudden change between substrate types (e.g., transitioning between a tile floor and carpet or vice versa).

Figure 6B:
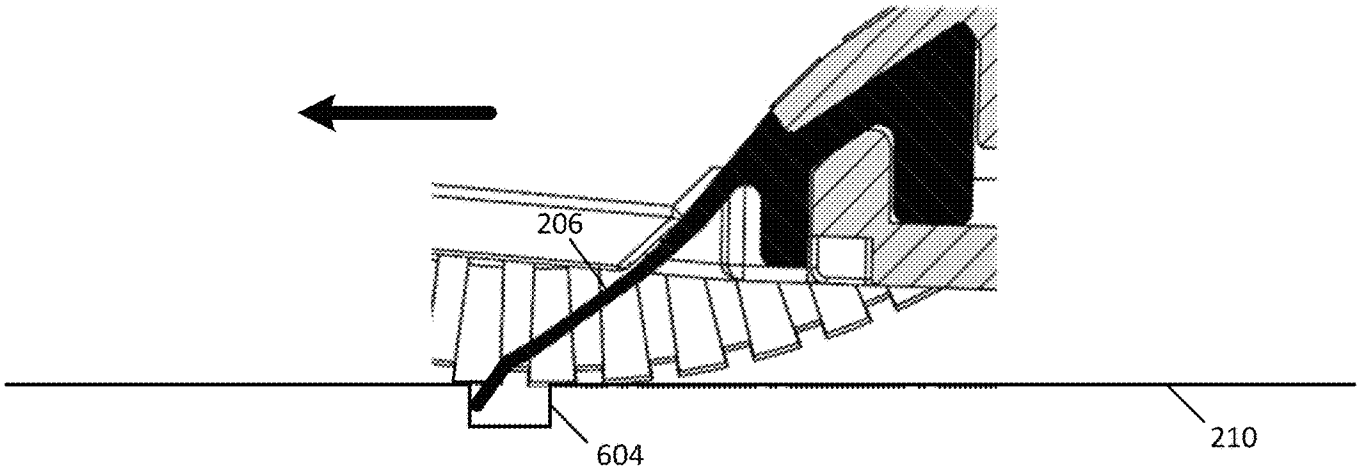
Figure 6C:
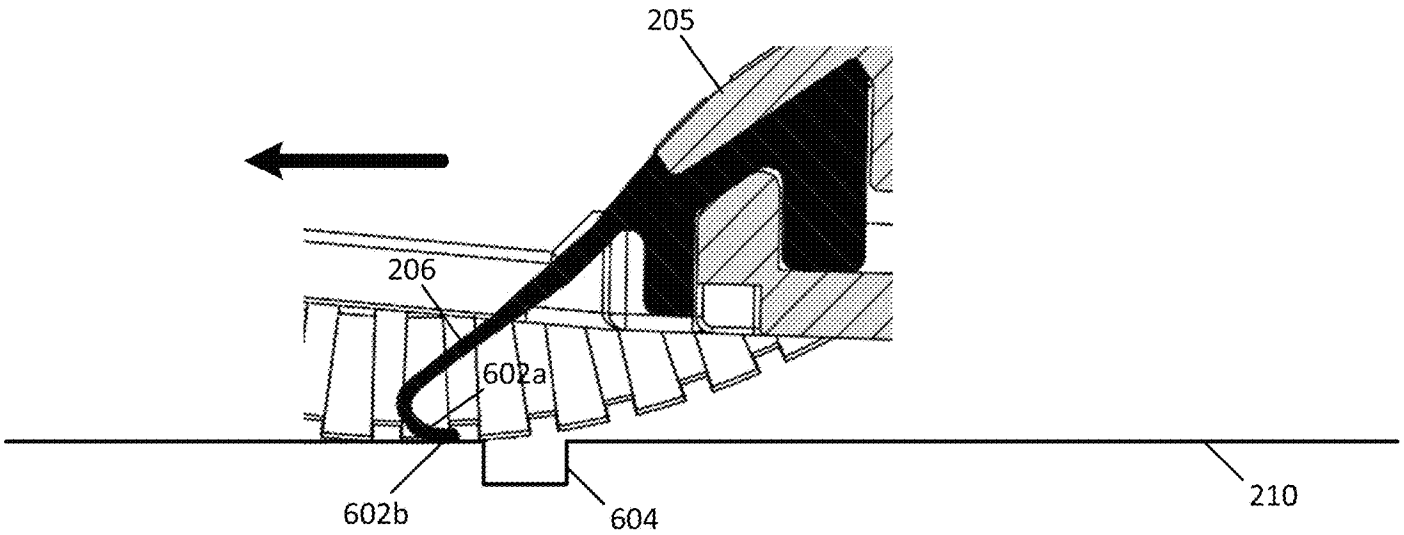

In FIG. 6B, brush assembly 106 has moved over obstacle 604. In the illustrated example, flexible flap 206 extends into obstacle 604. If the flap is not engineered correctly, such a situation may cause brush assembly 106 to catch on obstacle 604 either halting its movement or affecting its movement in some way. However, as seen in FIG. 6C, flexible flap 206 is designed to naturally curl inwards in response to interacting with obstacle 604. According to some embodiments, brush assembly 106 continues its movement across substrate surface 210 unimpeded while flexible flap 206 now moves across substrate surface 210 in a curled state. When flexible flap is in its curled state, second surface 602*b* at the distal end of flexible flap 206 contacts substrate surface 210, according to some embodiments. Due to the curled shape, second surface 602*b* can still be the top surface of flexible flap 206 as it extends towards ramp structure 205. According to some embodiments, flexible flap 206 has a given length and material composition such that under the weight of the cleaning device the distal end of flexible flap 206 curls with a given radius of curvature between about 0.03 mm and about 0.5 mm. In one example, a flexible flap having a thickness of around 0.4 mm at its distal end will curl along substrate surface 210 with a radius of curvature between about 0.5 mm and about 0.2 mm.

Figure 6D:
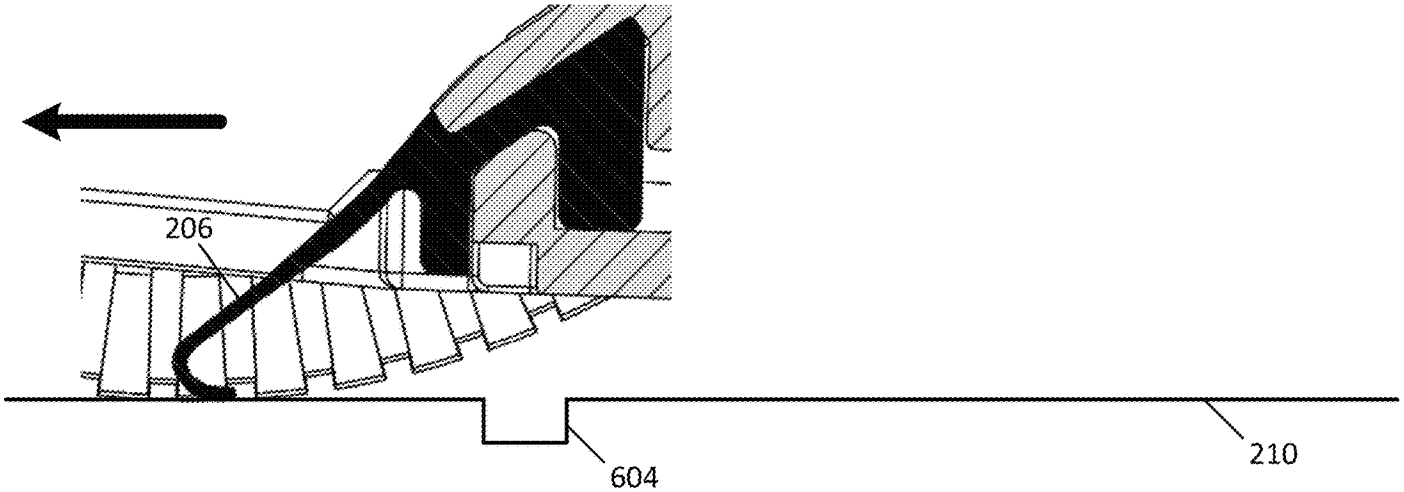

FIG. 6D illustrates the continued movement of brush assembly 106 across substrate surface 210 after passing obstacle 604. The radius of curvature of flexible flap 206 is small enough to allow flexible flap 206 to continue scraping along substrate surface 210 and to continue providing an inclined surface for directing debris towards ramp 205 and into catch tray 201 even in its curled state. According to some embodiments, lifting brush assembly 106 or moving brush assembly 106 in the opposite direction across substrate surface 210 will uncurl flexible flap 206 and return it to its normal state when interacting with substrate surface 210, as illustrated in FIG. 6A.

Numerous specific details have been set forth herein to provide a thorough understanding of the embodiments. It will be understood in light of this disclosure, however, that the embodiments may be practiced without these specific details. In other instances, well known operations and components have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

What is claimed is:

1. A floor cleaning tool, comprising:

a handle having a proximal end and a distal end;

a brush assembly at the distal end of the handle, the brush assembly comprising:

a rotatable brush head;

a ramp structure having a top surface; and a compliant scraper comprising a flexible flap and an anchor portion, the anchor portion coupled to the ramp structure such that the flexible flap extends away from the ramp structure, wherein a top surface of the flexible flap is coplanar with the top surface of the ramp structure, and wherein between 1.5 mm and 2 mm of a bottom surface of the flexible flap, opposite from the top surface, contacts a floor surface when the brush assembly is placed on the floor surface.

2. The floor cleaning tool of claim 1, wherein the brush assembly further comprises a baseplate along a bottom portion of the brush assembly, and wherein the top surface of the flexible flap exhibits an angle with the baseplate between about 30 degrees and about 60 degrees.

3. The floor cleaning tool of claim 1, wherein an entire length of a distal portion of the flexible flap is configured to contact a floor surface when the brush assembly is placed on the floor surface.

4. The floor cleaning tool of claim 3, wherein the entire length of the distal portion of the flexible flap is between 10% and 25% of a total length of the flexible flap extending away from the ramp structure.

5. The floor cleaning tool of claim 1, wherein the rotatable brush head comprises a plurality of bristles, and wherein the bristles contact at least a portion of the flexible flap during rotation of the rotatable brush head.

6. The floor cleaning tool of claim 1, wherein a seamless transition exists across the top surface of the flexible flap and a top surface of the ramp structure.

7. The floor cleaning tool of claim 1, wherein the flexible flap comprises a fabric layer and a polymer layer on the fabric layer.

8. The floor cleaning tool of claim 1, wherein the brush assembly further comprises a catch tray configured to collect debris swept up by the rotatable brush head, wherein the ramp structure is adjacent to the catch tray.

9. The floor cleaning tool of claim 1, wherein the flexible flap comprises PVC or silicone.

10. The floor cleaning tool of claim 1, wherein the compliant scraper comprises PVC or silicone.

11. The floor cleaning tool of claim 1, wherein the flexible flap has a thickness between about 0.5 mm and about 0.9 mm at a proximal end adjacent to the anchor portion, and a thickness between about 0.2 mm and about 0.6 mm at a distal end.

12. The floor cleaning tool of claim 11, wherein the proximal end of the flexible flap has a greater thickness than the distal end of the flexible flap.

13. A brush assembly configured for use within a cleaning tool, the brush assembly comprising:

a rotatable brush head;

a ramp structure having a top surface; and a compliant scraper comprising a flexible flap and an anchor portion, the anchor portion coupled to the ramp structure such that the flexible flap extends away from the ramp structure, wherein a top surface of the flexible flap meets the top surface of the ramp structure at an angle of less than 45 degrees, and wherein between 1.5 mm and 2 mm of a bottom surface of the flexible flap, opposite from the top surface, contacts a floor surface when the brush assembly is placed on the floor surface.

14. The brush assembly of claim 13, further comprising a baseplate along a bottom portion of the brush assembly, wherein the top surface of the flexible flap has an angle with the baseplate between about 30 degrees and about 60 degrees.

15. The brush assembly of claim 13, wherein an entire length of a distal portion of the flexible flap is configured to contact a floor surface when the brush assembly is placed on the floor surface.

16. The brush assembly of claim 15, wherein the entire length of the distal portion of the flexible flap is between 10% and 25% of a total length of the flexible flap extending away from the ramp structure.

17. The brush assembly of claim 13, wherein the rotatable brush head comprises a plurality of bristles, and wherein the bristles contact at least a portion of the flexible flap during rotation of the rotatable brush head.

18. The brush assembly of claim 13, wherein a seamless transition exists across the top surface of the flexible flap and a top surface of the ramp structure.

19. The brush assembly of claim 13, wherein the flexible flap comprises a fabric layer and a polymer layer on the fabric layer.

20. The brush assembly of claim 13, further comprising a catch tray configured to collect debris swept up by the rotatable brush head, wherein the ramp structure is adjacent to the catch tray.

21. The brush assembly of claim 13, wherein the flexible flap has a thickness between about 0.5 mm and about 0.9 mm at a proximal end adjacent to the anchor portion, and a thickness between about 0.2 mm and about 0.6 mm at a distal end.

22. The brush assembly of claim 21, wherein the proximal end of the flexible flap has a greater thickness than the distal end of the flexible flap.

* * * * *